United States Patent [19]

Liversidge

[11] Patent Number: 4,784,387

[45] Date of Patent: Nov. 15, 1988

[54] GAME

[76] Inventor: Thomas K. Liversidge, Crescent Surf, Kennebunk, Me. 04043

[21] Appl. No.: 150,986

[22] Filed: Feb. 1, 1988

[51] Int. Cl.[4] ..... A63F 3/00; A63F 9/00

[52] U.S. Cl. ..... 273/1 GD; 273/1 GF; 273/275; 446/103

[58] Field of Search ..... 273/19, 275, 276, 281; 446/103

[56] References Cited

U.S. PATENT DOCUMENTS

| | | | |
|---|---|---|---|
| 3,134,593 | 5/1964 | Monigal | 446/103 X |
| 3,172,666 | 3/1965 | Ryan | 446/103 X |
| 3,193,293 | 7/1965 | Schaper | 446/103 X |

FOREIGN PATENT DOCUMENTS

| | | | |
|---|---|---|---|
| 2641903 | 3/1978 | Fed. Rep. of Germany | 273/1 GF |
| 2315293 | 2/1977 | France | 273/276 |

*Primary Examiner*—Paul E. Shapiro

*Attorney, Agent, or Firm*—Z. T. Wobensmith

[57] ABSTRACT

A game is provided for educational and recreational use which includes an outer housing with a cut out opening, having a main drive gear and a plurality of ball control gears around the cut out. A spring impelled pop up plate is provided within the housing onto which magnetically retained gear devices are placed to provide gear trains between the main drive gear and the ball control gears for rotation and discharge of balls used with the game. The plate position is controlled by a timer to cause the plate to pop up at the end of a predetermined time interval and to break up the gear trains formed by the gear devices. The game can then be reset for the same or for a different time interval.

6 Claims, 5 Drawing Sheets

GAME

BACKGROUND OF THE INVENTION

This invention relates to an educational and recreational game of the type employing a pop up plate carrying magnetically retained gear devices which are arranged to complete as many gear trains in a selected time interval, and to collect balls which acle released by the gear train.

DESCRIPTION OF THE PRIOR ART

Games using timed pop up plates and pieces fitted into matching apertures are known in the art. Examples of such games are found in the U.S. patents to Klamer, et al. U.S. Pat. No. 2,994,967, Zalkind, U.S. Pat. No. 2,963,796; Miller, U.S. Pat. No. 2,911,740, Moskowitz, U.S. Pat. No. 3,500,556 and Liversidge, et al., U.S. Pat. No. 3,710,455. In my prior U.S. Pat. No. 3,710,455 game pieces of various shapes were placed into matching apertures, with a pop up plate coming up in a predetermined time to dislodge them from the apertures. While my prior patented structure is quite satisfactory, there has existed a need for a game that does not have fixed points of reference for insertion of the game pieces. The game of my invention provides for an increased level of spatial and mechanical operation skills and can be played by virtually anyone.

SUMMARY OF THE INVENTION

In accordance with the invention an educational and recreational game is provided having a housing with a centrally located cut out, around the periphery of which is a main drive gear and a plurality of ball control gears, a pop up plate is provided below the cut out onto which a plurality of magnetically retained gear devices are placed to complete gear trains, and to rotate ball control gears to release balls, during a predetermined time interval after which the pop-up plate is released and moves upwardly to break up the gear trains.

It is the principal object of the invention to provide an educational and recreational game which is challenging and developes spatial and mechanical operation skills in forming gear trains to cause balls to be released during a predetermined time interval after which the gear trains are broken up.

It is a further object of the invention to provide a game of the character aforesaid which is simple to construct, compact and self-contained.

It is a further object of the invention to provide a game of the character aforesaid which can provide for multiple gear combinations.

It is a further object of the invention to provide a game of the character aforesaid which improves and educates the players in the mechanics of gear operation and characteristics.

It is a further object of the invention to provide a game of the character aforesaid which permits of varying the level of skill required to play the game.

It is a further object of the invention to provide a game of the character aforesaid which requires a minimum of parts.

It is a further object of the invention to provide a game of the character aforesaid which is sturdy and reliable in operation.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part thereof in which.

Figure 2:
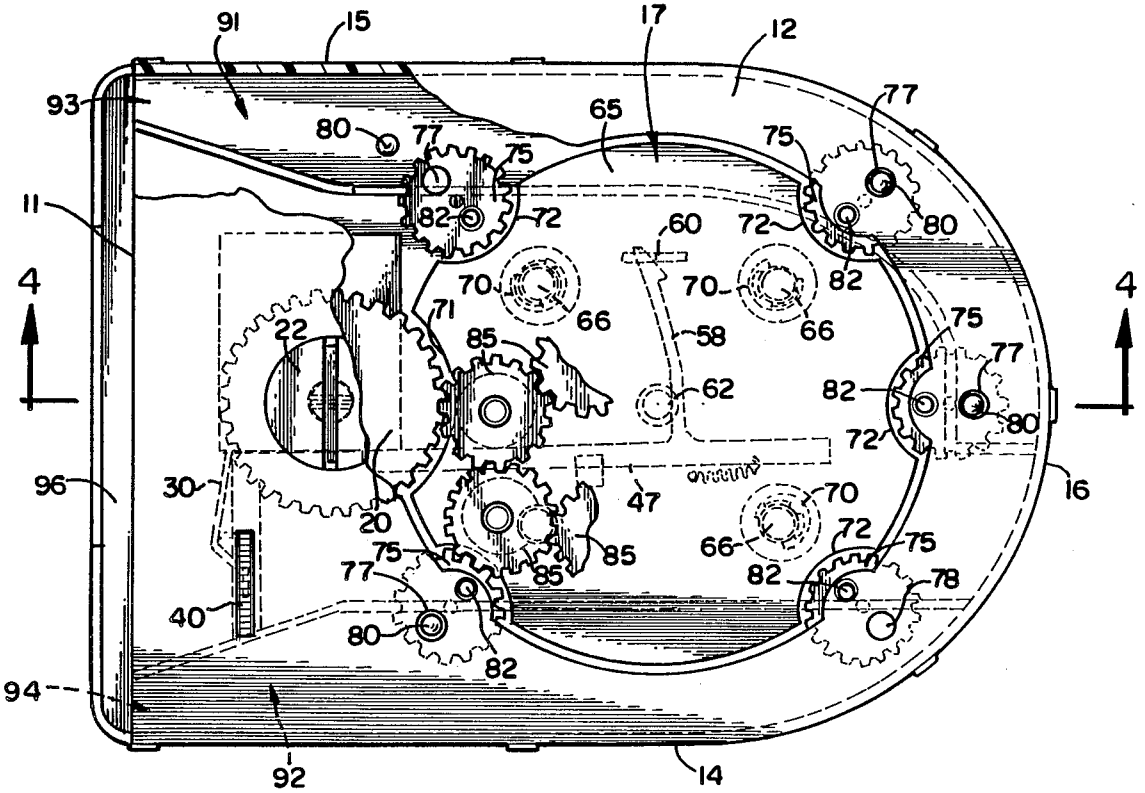
FIG. 2 is a top plan view of the game of FIG. 1 partially broken away to show the interior details of the game.

FIG., 4 is a vertical sectional view taken approximately on the line 4—4 of FIG. 2 and showing the pop up plate in the engaged position.

Figure 1:
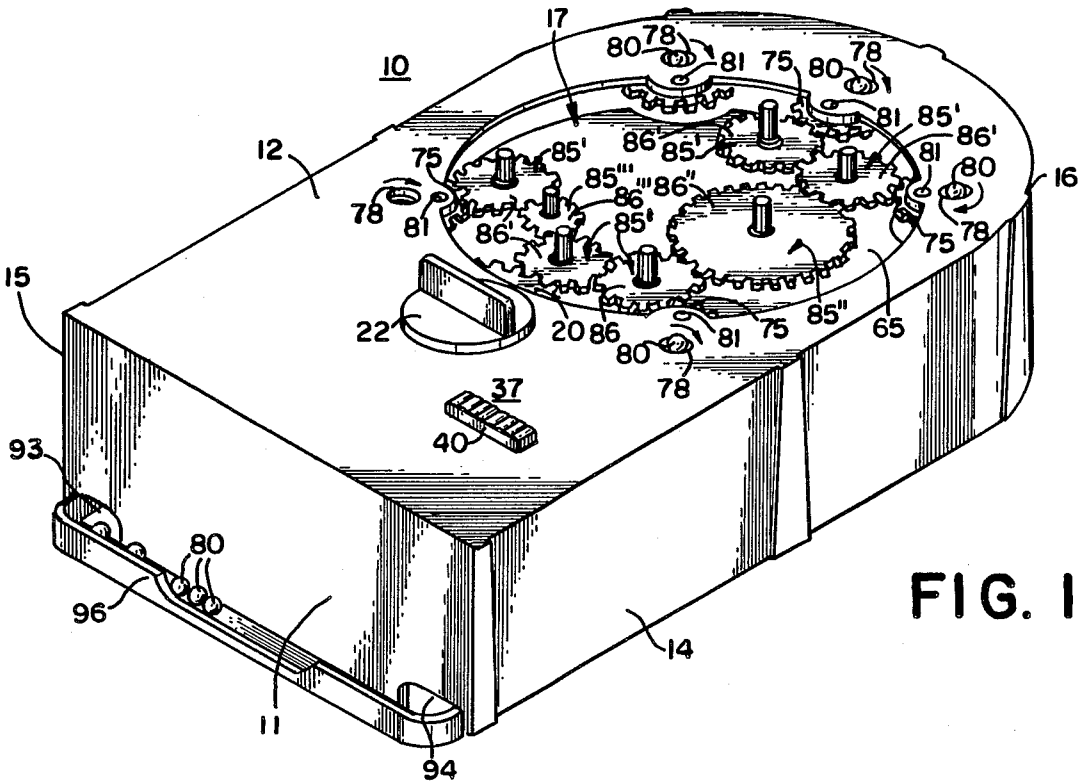
FIG. 1 is a perspective view of the game of the invention.
Figure 4:
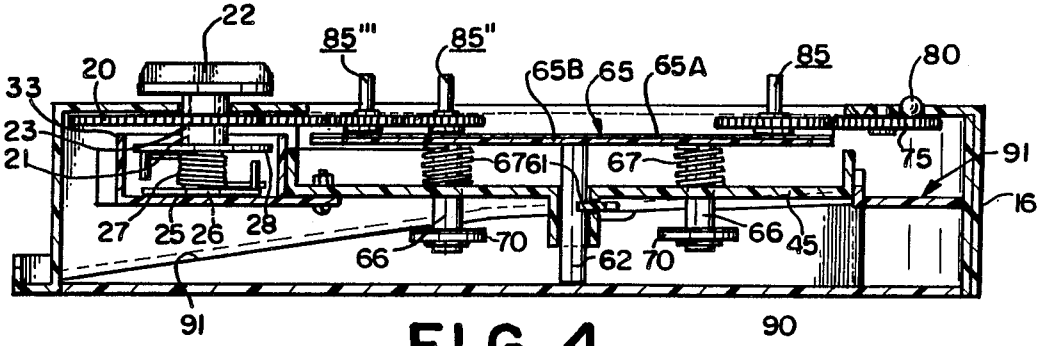
Figure 4A:
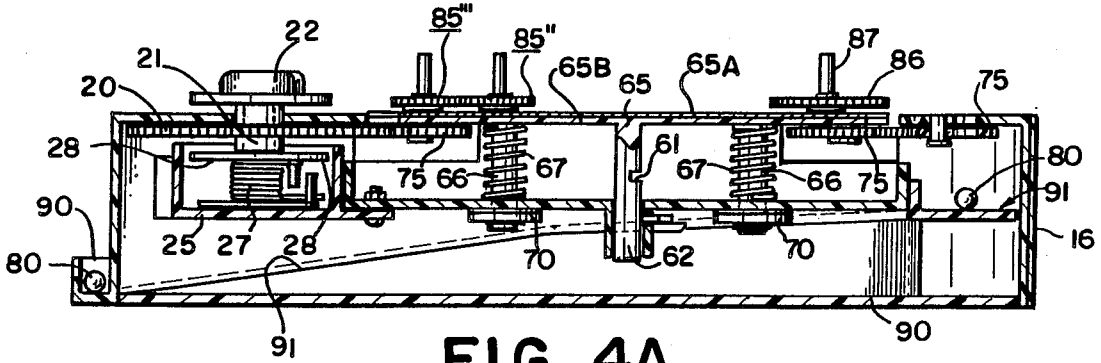
Figure 5A:
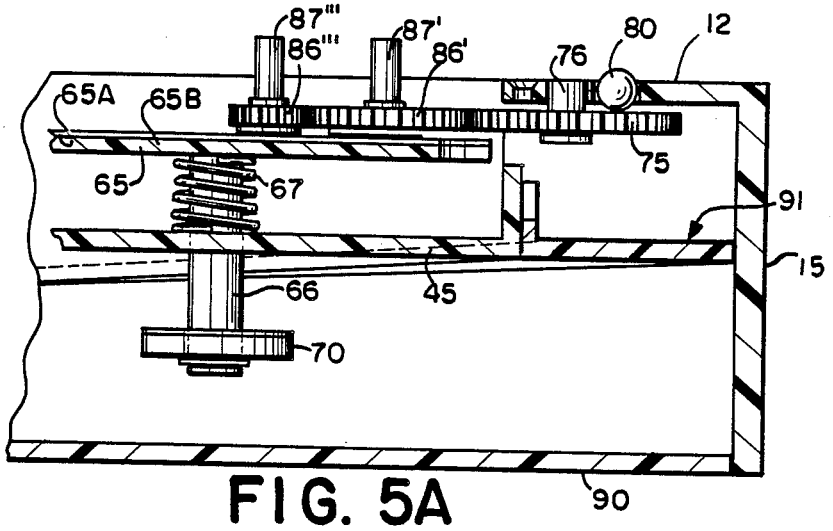
Figure 5B:
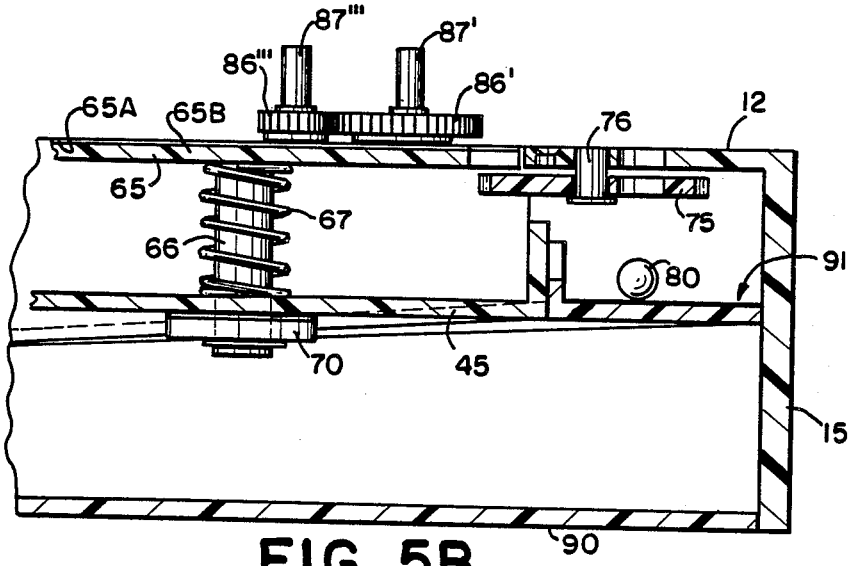
Figure 6:
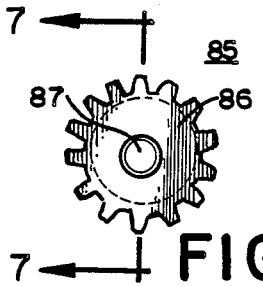
Figure 7:
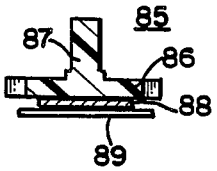

FIG. 4A is a view similar to FIG. 4 but showing the pop up plate in the disengaged position;

FIG. 5A is an enlarged fragmentary view of a portion of the game of FIG. 4;

FIG. 5B is an enlarged fragmentary view of a portion of the game of FIG. 4A;

FIG. 6 is a top plan view, enlarged, of a gear device used with the game of FIG. 1, and FIG. 7 is a vertical sectional view taken approximately on the line 7—7 of FIG. 6.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings the game in accordance with the invention includes a housing 10 having front wall 11, top wall 12, opposite side walls 14 and 15 and rear wall 16.

The top wall 12 has a cut out opening 17 therein, with a main drive gear 20 adjacent front wall 11 and below top wall 12 and extending partially out into the opening 17.

The drive gear 20 is mounted on a shaft 21 which has a timer set knob 22 engaged therewith above top wall 12 for rotation to be described. The shaft 21 is journaled in bushing 23 which is part of top wall 24 of housing 25, and at its lower end is carried in an intermediate wall 26 of housing 25. The shaft 21 has a spring 27 therearound engaged in intermediate wall 26 and with gear 28 on shaft 21, for rotation. Gear 28 is of the escapement type and has a projection 29 from an escapement arm 30 engaged therewith to restrict rotation of gear 28. The escapement arm 30 is of conventional type, mounted in top wall 24 and in intermediate wall 33. The escapement arm 30 has an end portion 35 at the end opposite to projection 29, which can be selectively engaged by a stop member 36 from an on-off switch 37, which is mounted to top wall 12 by tabs 38. The on-off switch 37 extends through an opening 39 in top wall 12, and includes a ribbed bar 40 for engagement by a player to be described.

Figure 3:
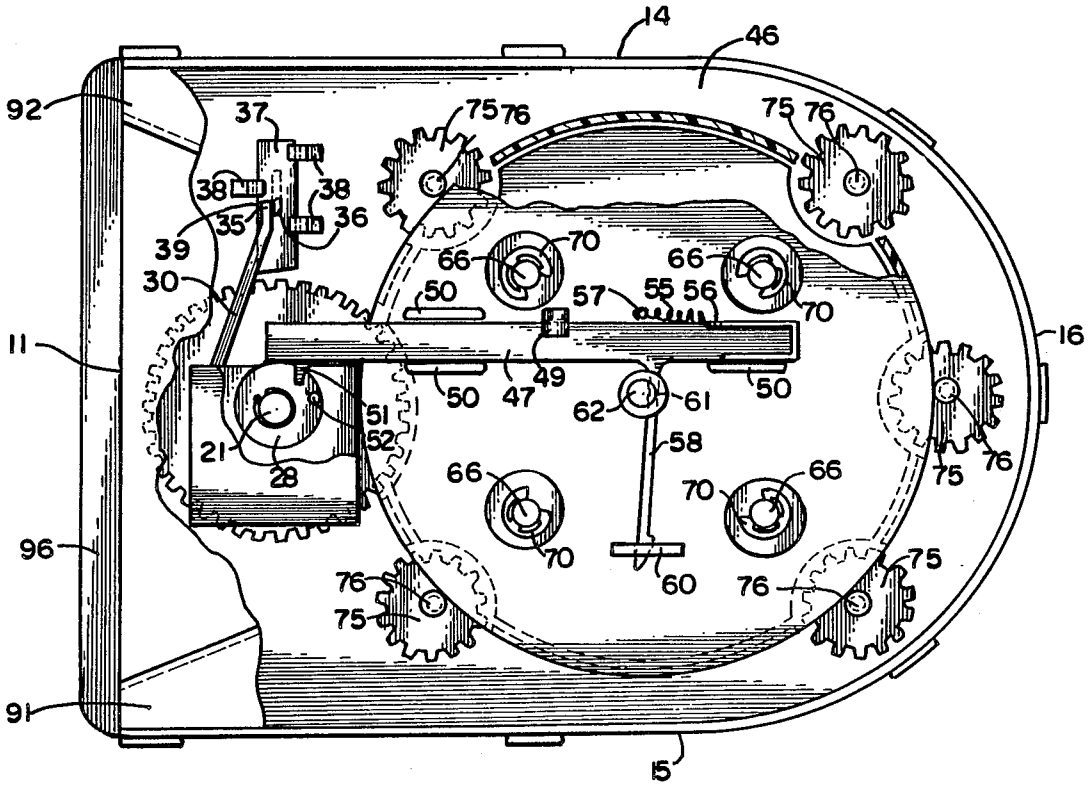
FIG. 3 is a bottom plan view of the game of FIG. 1 partially broken away to show the interior details of the game.

A circular housing 45 is provided adjacent to housing 25 and fixed to the underside 46 of top wall 12. The housing 45 has a latch 47 slidably mounted on its bottom wall 48 by tabs 49 and guide 50 and has a finger 51 which extends into housing 25 for selective engagement by a downwardly extending pin 52 carried by gear 28. The latch 47 is urged to the left, as seven in FIG. 3, by a spring 55 engaged with a projection 56 on lever 47 and a post 57 on housing 45. The latch 47 has an arm 58 extending therefrom, with its end engaged by a tab 60 on housing 45. The arm 58 is selectively engaged in a groove 61 in a shaft 62, which extends down through a hole 63 in housing wall 48 and carries a pop-up plate 65 thereon. The pop-up plate 65 as illustrated is constructed of a layer 65A of magnetic responsive metallic material of well known type bonded to a layer 65B of non-magnetic plastic. The plate 65 is of circular configuration and slightly smaller than cut out opening 17 of top wall 12. The pop-up plate 65 has downwardly projecting posts 66 four being illustrated which carry springs 67 thereon, and which posts 66 extend through openings 68 in housing bottom wall 48. The springs 67 urge plate 65 upwardly, and posts 66 below wall 48 have C-clips 70 thereon which act as stops to restrict the upward travel of the plate 65.

The pop-up plate 65 has a series of six cut outs 71 and 72 spaced therearound, to accomodate the main drive gear 20, and five ball control gears 75 rotatably mounted on shafts 76 extending downwardly from the underside 46 of top wall 12.

The gears 75 each have an opening 77 therein which can be moved underneath corresponding openings 78 in top wall 12 to permit the passage of balls 80 to be described.

The top wall 12 has additional openings 81 adjacent each gear 75 to view indicia 82 on the gear which may be a colored dot. The top wall 12 may also be provided with indicia such as arrows 83 to indicate the preferred direction of rotation of gears 75.

Referring more specifically to FIGS. 6 and 7 a gear device 85 is therein illustrated, which includes a gear 86 mounted to a shaft 87 carried on a base 88, and which as illustrated has a piece of magnetic material 89 on the bottom thereof for interaction with the pop up plate 65.

While the pop-up plate 65 has been described as being of non-magnetic material and the gear device 85 as having magnetic material, opposite materials could be used with the plate 65 being of magnetic material and the gear devices 75 having non-magnetic material.

As shown in FIG. 1 there may be used a variety of gear devices 85, 85', 85'' and 85''' which differ in that the gears 86, 86', 86'' and 86''' vary in diameter and which can be varied to change the skill and dexterity required by a player.

The housing 10 has a base plate 90 to close off the bottom and which can be placed on a support surface (not shown) as desired. The base plate 90 can be retained thereon in any desired manner such as by screws (not shown), the base plate 90 has two inclined ramps 91 and 92 which extend around side walls 14 and 15 and meet at rear wall 16.

The ramps 91 and 92 incline upwardly to rear wall 16 and downwardly to front wall 11, with openings 93 and 94 to a trough 96 which receives balls 80 from the ramps 91 and 92.

The mode of operation will now be pointed out. For operation the on-off switch is set to off, and the set knob 22 is rotated against spring 27 until the spring is wound and held against rotation by the escapement arm 30. The ball control gears 75 are rotated to place the indicia 82 under the openings 81 and balls 80 are placed in openings 78. The pop-up plate 65 is urged downwardly against the force of springs 67 until arm 58 engages groove 61 in shaft 62, and restrains plate 65 from upward movement.

The on-off switch 37 is moved to the on position and escapement arm 30 is released, which causes it to oscillate and permits drive gear 20 to rotate. The player picks up gear devices such as 85 and places them to form gear trains between drive gear 20 and ball control gears 75 so that the gears 75 will rotate and openings 78 and 77 line up, so that balls 80 may pass therethrough onto the ramps 91 and 92, and be discharged to trough 96.

The timer control knob may be set to provide the desired time, which can be two minutes, after which latch 47 is engaged by pin 52 and urged to the right thereby releasing arm 58 from the groove 61 in shaft 62, whereby plate 65 is urged upwardly by springs 67 and any gear trains are disrupted. The object of course being to build as many gear trains as possible and to have as many balls 80 in trough 96 prior to plate 65 disrupting the gear trains.

It will thus be seen that a game has been described with which the objects of the invention are achieved.

I claim:

1. An educational and recreational game comprising
a housing having a front wall, a rear wall, side wall and a top wall with a cut out opening,
drive gear means mounted to said top an having a drive gear which projects into said cut-out opening,
at least one ball control gear means around said cut out opening mounted to said top plate and having a gear which projects into said opening,
a pop up plate in said cut out opening,
said pop up plate having cut-outs spaced to accomodate said gears from said drive gear means and said ball control means,
said top plate having openings for insertion of balls,
said ball control gears having openings for positioning below said top plate openings to selectively permit said balls to pass therethrough,
ramp means below said top plate openings to receive said balls,
latch means for engagement with said pop up plate,
timer means to release to said latch means and cause said pop-up plate to move upwardly,
a plurality of gear devices for engagement with said drive gear and said ball control gear to form at least one gear train for rotation of said ball control gears,
magnetic means to releasably restrain said gear means on said top plate, and
ball means for use with said game.

2. A game as defined in claim 1 in which
said ball control gears having location indica thereon and
said top plate having openings for viewing said indicia.

3. A game as defined in claim 1 in which
said gear devices are of different size.

4. A game as defined in claim 1 in which
said pop up plate is of non-magnetic metallic material and
said gear device includes a magnetized portion for engagement with said pop up plate.

5. A game as defined in claim 1 in which
said pop up plate is of magnetized material and
said gear device includes a non-magnetic metallic portion.

6. A game as defined in claim 1 in which said ramp means includes a detachable base plate with two ramps that extend around the inside periphery of said housing and terminate adjacent said front wall, and a trough is provided on the front of said front wall in communication with said ramps.

* * * * *